United States Patent [19]

Hoener

[11] 4,432,218

[45] Feb. 21, 1984

[54] LOCKING KEY WITH MEMORY

[76] Inventor: Jost Hoener, Bühlackerstrasse 19/B, Vörstetten, Fed. Rep. of Germany

[21] Appl. No.: 327,235

[22] Filed: Dec. 3, 1981

[30] Foreign Application Priority Data

Dec. 8, 1980 [DE] Fed. Rep. of Germany ..... 3046215
Aug. 4, 1981 [DE] Fed. Rep. of Germany ..... 3130744

[51] Int. Cl.[3] ..... E05B 19/00; E05B 19/04; E05B 41/00

[52] U.S. Cl. ..... 70/395; 70/408; 70/432

[58] Field of Search ..... 70/395, 408, 432, 433, 70/436, 437

[56] References Cited

U.S. PATENT DOCUMENTS 729,773 6/1903 Ketz et al. ..... 70/432
1,237,115 8/1917 Stein ..... 70/432
2,198,484 4/1940 Merkl ..... 70/432

FOREIGN PATENT DOCUMENTS 2634969 2/1978 Fed. Rep. of Germany ..... 70/432
236199 6/1945 Switzerland ..... 70/432

*Primary Examiner*—Robert L. Wolfe
*Attorney, Agent, or Firm*—Karl F. Ross

[57] ABSTRACT

A locking key, designed to retain an indication of the lock-shifting (opening or closing) operation last performed, has a head and a shank interconnected by a screw coupling with limited axial play enabling their relative rotation through 90° or 180°. The shank and its bit can thus be positively entrained for a lock-opening or a lock-closing motion only after the head has arrived in one or the other limiting angular position relative thereto. When the idle rotation of the head is 180°, the relative angular position of the two parts can be indicated by special markings thereon.

7 Claims, 5 Drawing Figures

LOCKING KEY WITH MEMORY

FIELD OF THE INVENTION

My present invention relates to a locking key with a memory, designed to retain an indication of the lock-shifting operation last performed in order to remind a user whether the corresponding lock has been left open or has been closed.

BACKGROUND OF THE INVENTION

A locking key of this general type has been described in German laid-open specification (Offenlegungsschrift) No. 26 34 969, published Feb. 9, 1978. The key of that publication has a manually grippable head member and a bit-carrying shank member which are limitedly relatively rotatable about an axis parallel to the longitudinal direction of the shank member; the latter has an enlarged tubular neck which accommodates a cylindrical boss of the head member centered on the axis of rotation. In one disclosed mode of realization, the boss is surrounded by a friction ring forming a lost-motion rotary coupling between the head and the shank, the tubular neck having a window enabling the viewing of color markings which visually distinguish between the two limiting relative positions. In another disclosed mode of realization, the friction ring is replaced by two oppositely effective one-way clutches through which the head can entrain the clutch in one or the other direction of rotation upon being shifted into a respective axial position.

OBJECTS OF THE INVENTION

The general object of my present invention is to provide a simplified lost-motion rotary coupling between a head member and a shank member of a key or this type.

A more particular object is to provide a key structure for the purpose set forth which does not require any excessive enlargement of either the head member or the shank member, dispenses with the need for an interposed friction ring and allows the key to be operated in the normal way, i.e. without any preliminary axial shift.

SUMMARY OF THE INVENTION

I realize these objects, in accordance with my present invention, by providing one of the two relatively rotatable members—preferably the shank member—with an axially extending threaded bolt received in a matingly threaded bore of the other member, the relative rotation of the two members being restricted, preferably to a fraction of a turn, by abutment means establishing positive contact therebetween in two limiting positions.

According to a more particular feature of my invention, the bolt secured to the shank member has an extremity projecting beyond the bore axially traversing the head member and carrying a terminal element; the shank member and the terminal element have transverse shoulders, forming part of the aforementioned abutment means, which confront respective lands on the head member and are separated from each other by a distance exceeding the separation of the confronting lands by a fractional pitch of the bolt threading. A gap equal to this fractional pitch will then exist between one shoulder and the confronting land in a first limiting position and between the other shoulder and land in a second limiting position.

Through a suitable arrangement of the abutment means, the two limiting positions are preferably separated by a whole number of quarter turns of relative rotation. If this separation equals 180°, and if the head member is substantially symmetrical about an axial plane as is usually the case, identification of one or the other position by the user will be aided by visual markings on the two members, e.g. by matching colors, numerals or other legends on major surfaces thereof which are parallel to each other in both positions. Such parallelism, especially when the head member is a substantially flat disk, will enable the key to be held in a narrow case when not in use. Alternatively, it is possible to limit the relative rotatability of the two members to 90° so that their major surfaces are perpendicular to each other in one limiting position whereby a user, finding it difficult to fit the key into the case, will be reminded that a door has been left unlocked.

BRIEF DESCRIPTION OF THE DRAWING

The above and other features of my invention will now be described in detail with reference to the accompanying drawing in which.

SPECIFIC DESCRIPTION

Figure 1:
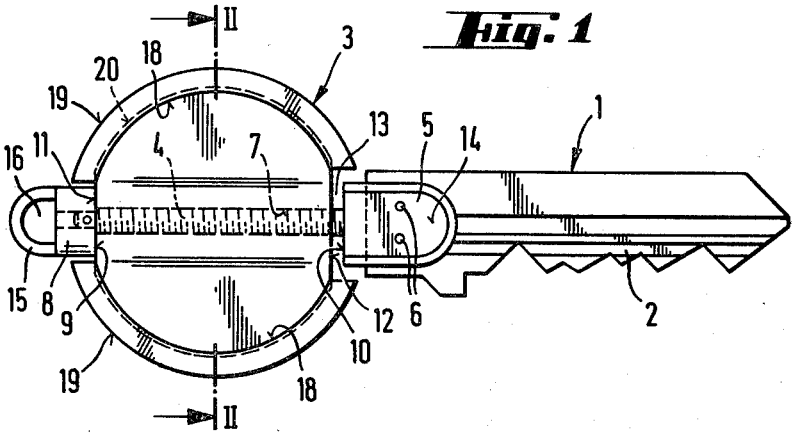
FIG. 1 is a face view of a key embodying my invention.

The locking key shown in the drawing comprises a shank member 1 with a bit 2 and a head member 3 in the form of a substantially flat disk. A bolt 4 in line with shank member 3, secured thereto with the aid of a connector 5, is received in a matingly threaded bore 7 axially traversing the head member 3. Connector 5 is a bifurcate extension of bolt 4 which straddles the end of shank 1 proximal to head 3 and is fastened thereto by pins 6. A free extremity of bolt 4, projecting beyond bore 7, carries a terminal element 8 having a loop 15 which facilitates the attachment of the key to a key ring by its aperture 16.

Figure 2:
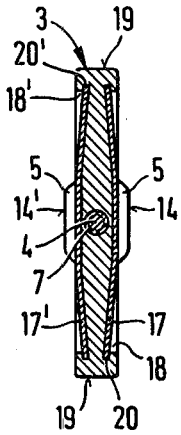
FIG. 2 is a cross-sectional view taken on the line II—II of FIG. 1.
Figure 3A:
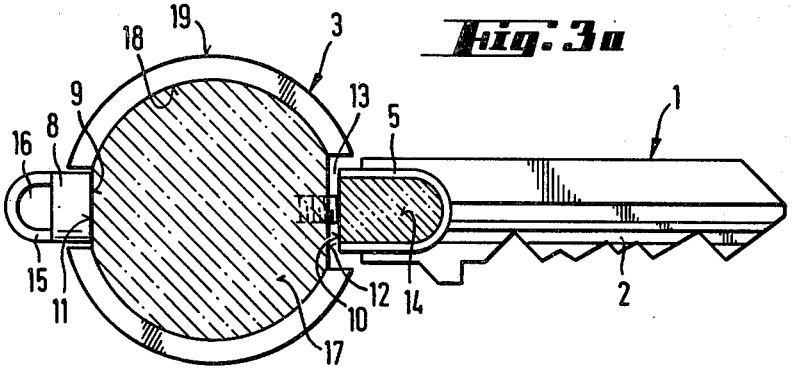
FIGS. 3*a* and 3*b* are two views similar to FIG. 1, showing the key provided with distinctive markings in two opposite limiting positions.
Figure 3B:
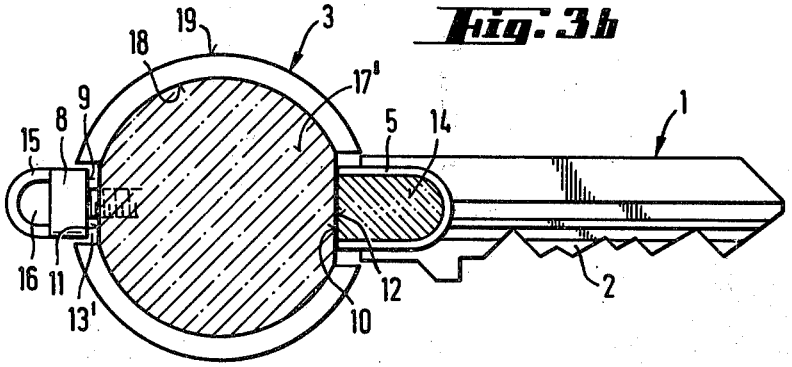

Terminal element 8 and connector 5 form transverse shoulders 9 and 10 which confront respective flat edges 11 and 12 of head 3. With the distance between shoulders 9 and 10 exceeding the distance between edges 11 and 12 by half a pitch of the thread of bolt 4, a gap 13 of a width equal to that half-pitch exists between shoulder 10 and edge 12 in the position of FIGS. 1 and 3*a* whereas a gap 13' of like width separates shoulder 9 from edge 11 in the position of FIG. 3*b* after a relative rotation of head 3 and shank 1 through half a turn. With a right-handed thread as shown, closure of gap 13 requires a clockwise rotation of head 3 from the position of FIG. 1 as viewed in FIG. 2 and as seen by a user inserting the shank 1 into a lock. Once the position of FIG. 3*b* is attained, continued rotation in the same direction will drive the lock itself in a given sense, e.g. to open it. For subsequent closure of the lock, the user will first have to impart to head 3 and idle 180° rotation in the reverse direction (counterclockwise in the case assumed) before the elimination of gap 13' enables positive entrainment of the shank 1 in the desired sense.

It will generally be desirable to make the pitch angle of bolt 4 slightly smaller than the angle of repose between shoulders 9, 10 and lands 11, 12 to avoid accidental dislodgment of the head 3 from the limiting position last assumed when the key is being carried on the person of the user; placing the key in a flat case will, of course, always prevent an untimely relative rotation. In any event, the torque needed to leave the limiting position should be substantially less than that required for shifting the lock.

While the direction of the last key rotation—and thus the presumed state of the associated lock—can be ascertained from the presence of gap 13 or 13', I prefer to provide the members 1 and 3 with more readily observable markings indicative of their relative position. Thus, as best seen in FIG. 2, the disk-shaped head 3 can be formed on its opposite faces with recesses 18, 18' which deepen toward its rim 19 and end in peripheral undercuts 20, 20' facilitating the insertion of respective foils 17, 17' of differently colored sheet material. In the position of FIG. 3*a*, assumed to be reached after closure of the lock, the colors of inserts 17 and 17' respectively match those of adjoining faces 14, 14' of connector 5; in the position of FIG. 3*b* the colors are mismatched since inserts 17 and 17' respectively adjoin faces 14' and 14.

Figure 4:
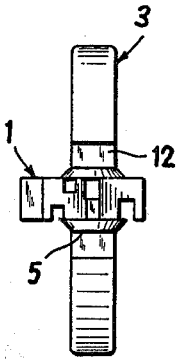
FIG. 4 is an end view of such a key in an alternate limiting positions.

With the construction just described, the key is flat in both limiting positions of members 1 and 3 as their major surfaces are then parallel to one another. In some instances it may, however, be desirable to reduce the gaps 13, 13' to half their aforementioned width so that the major surfaces of their head and shank members are mutually perpendicular, as shown in FIG. 4, in one such limiting position. When that position is attained upon the opening of the associated lock, the user will be alerted to the unlocked state by the difficulty or impossibility of fitting the key into its case.

I claim:

1. A locking key comprising:

a head member grippable by fingers of a user;

a shank member provided with a lock-operating bit;

coupling means enabling relative rotation of said members about an axis extending in longitudinal direction of said shank member, said coupling means being constituted by an axially extending threaded bolt rigid with said shank member received in a matingly threaded bore axially traversing said head member; and abutment means on said members restricting said relative rotation by establishing two axially spaced positions of positive contact between said shank member and said head member to enable entrainment of the former by the latter in respective directions of rotation; said abutment means comprising a first transverse shoulder on said shank member and a second transverse shoulder on a terminal element secured to a projecting extremity of said bolt remote from said shank member, said first and second shoulders respectively confronting first and second lands of said head member at the ends of said bore, said shoulders being separated from each other by a distance exceeding the mutual separation of said lands by a fractional pitch of the threading of said bolt whereby a gap equal to said fractional pitch exists between said first shoulder and said first land in a first limiting position and between said second shoulder and said second land in a second limiting position.

2. A locking key as defined in claim 1 wherein said positions of positive contact are separated by a whole number of quarter turns of said relative rotation.

3. A locking key as defined in claim 2 wherein said positions of positive contact are separated by a relative rotation of 180°, said head member and shank member having major surfaces parallel to each other in each of said positions of positive contact.

4. A locking key as defined in claim 3 wherein said members are provided on their major surfaces with respective markings visually distinguishing said positions of positive contact from each other.

5. A locking key as defined in claim 4 wherein said head member is a substantially flat disk with two recessed faces occupied by differently colored inserts, said shank member being provided on opposite sides with differently colored areas matching the coloring of said inserts, the colors of said inserts and said areas constituting said markings.

6. A locking key as defined in claim 4 wherein some of said markings are carried on a connector securing said bolt to said shank member.

7. A locking key as defined in claim 2 wherein said positions of positive contact are separated by a relative rotation of 90°, said head member and said shank member having major surfaces which are parallel to each other in one and perpendicular to each other in the other of said positions of positive contact.

* * * * *